United States Patent [19]

Banyai et al.

[11] Patent Number: 4,919,711

[45] Date of Patent: Apr. 24, 1990

[54] BINDER FOR METAL-CONTAINING ORES

[75] Inventors: Bruce E. Banyai, Hockessin; Denis E. LaSota; Dennis L. Struck, both of Wilmington, all of Del.

[73] Assignee: Aqualon Company, Wilmington, Del.

[21] Appl. No.: 347,114

[22] Filed: May 1, 1989

Related U.S. Application Data

[63] Continuation-in-part of Ser. No. 67,753, Jun. 29, 1987, Pat. No. 4,863,512.

[30] Foreign Application Priority Data

Jun. 29, 1988 [EP] European Pat. Off. ..... 88.110395.6

[51] Int. Cl.[5] ..... C22B 1/16

[52] U.S. Cl. ..... 75/321; 106/194; 75/767

[58] Field of Search ..... 106/194; 75/3, 5, 4, 75/0.05 R

[56] References Cited

U.S. PATENT DOCUMENTS

| | | |
|---|---|---|
| 3,376,145 | 4/1968 | Wallace . |
| 3,893,847 | 7/1975 | Derrick . |
| 4,288,245 | 9/1981 | Roorda et al. . |
| 4,597,797 | 7/1986 | Roorda et al. . |
| 4,614,539 | 5/1985 | Rosen et al. . |

FOREIGN PATENT DOCUMENTS

| | | |
|---|---|---|
| 0026178 | 3/1971 | Australia . |
| 46544/88 | 8/1985 | Australia . |
| 0203854 | 3/1986 | European Pat. Off. . |
| 0203855 | 3/1986 | European Pat. Off. . |
| 38-185323 | 12/1963 | Japan . |
| 1198128 | 1/1984 | U.S.S.R. . |

OTHER PUBLICATIONS

Chemical Abstracts, vol. 108, 1988, p. 257, #135852y, 12/15/87.

Chemical Abstracts, vol. 97, 1982, p. 253, #76314d, 12/82.

Chemical Abstracts, vol. 74, 1971, p. 114, #143877e, 12/70.

"Organic Binders for Iron Ore Pelletization", Kater and Steeghs, 12/88.

"Substitutes for Western Bentonite in Magnetic Taconite Pellets", Society of Mining Engineers of AIME, Prepublication No. 76-B-1112, (1976), Clum, Heins and Tiemann.

"Role of Detergent Builders in Fabric Washing Formulations", 55 J. Am. Oil Chemists', Soc. 49, (Jan. 1978), M. W. Hollingsworth.

"Surfactants and Detergent Raw Materials", Chemical Economics Handbook—SRI Int'l., (Aug. 1981).

*Primary Examiner*—S. Kastler

*Attorney, Agent, or Firm*—Mark D. Kuller

[57] ABSTRACT

A binder useful for agglomerating a concentrated ore material in the presence of water comprising (a) a water-soluble polymer selected from the group consisting of alkali metal salts of carboxymethyl celluylose or carboxymethyl hydroxyethyl cellulose and (b) sodium tripolyphosphate, a process for agglomerating the concentrated ore material using this binder, and the agglomerated product of this process, are disclosed.

20 Claims, No Drawings

BINDER FOR METAL-CONTAINING ORES

This is a continuation-in-part of U.S. patent application No. 07/067,753, U.S. Pat. No. 4,863,512 filed June 29, 1987, entitled "Binder For Metal-Containing Ores".

This invention is directed to a novel binder for agglomerating concentrated ore, a novel process for agglomerating concentrated ore using this binder, and the agglomerated product of this process. More specifically, this invention is directed to a binder useful for agglomerating or pelletizing particles of a concentrated ore, in particular, iron-containing ore, containing (a) an alkali metal salt of carboxymethyl cellulose or carboxymethyl hydroxyethyl cellulose and (b) sodium tripolyphosphate, the process of agglomerating or pelletizing the concentrated ore and the resulting agglomerated particles or pellets.

Raw or pig iron, used for making steel, is generally prepared by sintering a composition consisting of concentrated iron ore, consisting of iron oxide and residual silica (e.g., quartz), flux (e.g., limestone or dolomite), and coke. The flux is added to purge impurities, i.e., neutralize the silica. Slag, which results from this neutralization process, separates from the molten iron in the blast furnace. There is presently a desire to increase the efficiency of blast furnaces by reducing the volume of slag. Correspondingly, it is desired to reduce the cost of steel by reducing the amount of flux necessary for producing pig iron, i.e., by reducing the amount of silica entering the blast furnace.

The concentrated iron ore used in steel making is obtained from mined ores comprised of iron oxide and host rock, i.e., silica. In order to reduce shipping and handling costs iron oxide is normally separated from the host rock at or near the mine by, for example, magnetic and/or froth flotation processes. Many ores, in particular the taconite ore found in North America, require ultra fine grinding prior to carrying out such separation processes. Due to this grinding the resulting concentrated ore is a fine powder which cannot be easily handled, shipped, or charged to a blast furnace. Therefore, the concentrated ore is agglomerated into porous particles or pellets generally having an average diameter of approximately ⅜ inch by rotating the concentrated ore powder in a drum or disc with a binder and water to form balls, followed by firing the balls at about 2400° F. in an indurating furnace. The resulting particles or pellets are hard and are easily handled, shipped, and charged to a blast furnace. Until recently, bentonite clay was the binder of choice for agglomerating concentrated ore particles as it provides moisture and growth control, and balls prepared with bentonite have very good wet and dry strength. One problem with bentonite is that it contains a large amount of silica. In the blast furnace, this silica must be neutralized by adding additional amounts of flux over that required to neutralize the host rock. Accordingly, there has been a desire to replace bentonite with a product that has all the attributes of bentonite, but does not contribute silica to the pellet. The so-called "organic based binders", such as the alkali metal salts of carboxymethyl cellulose, have been considered as replacements for bentonite as they do not contain silica and, therefore, do not require use of additional flux and create additional slag. Instead, they burn off during sintering.

In the blast furnace, reducing gases, such as carbon monoxide, reduce iron oxide to the metallic state. The rate of reduction is directly proportional to the ratio of surface area/mass of the concentrated ore-containing pellets. The pore volume and, thus, the surface/mass ratio of pellets produced using organic binders is larger than that of pellets produced using bentonite. Moreover, during sintering, bentonite fuses to a glass-like ceramic material which seals pores. In contrast, the pore volume of pellets produced using organic binders increases as the organic binder burns off. Due to the larger surface area of the pellets produced using organic binders their reduction is much more efficient than is that of pellets prepared with bentonite.

Although the alkali metal salts of carboxymethyl cellulose are effective binders, they do not impart adequate dry strength at economical use levels. Roorda, in U.S. Pat. Nos. 4,288,245 and 4,597,797, discloses that the performance of alkali metal salts of carboxymethyl cellulose can be improved by inclusion of one or more salts derived from an alkali metal and a weak acid having a pK value higher than 3 and a molecular weight lower than 500, in amount of at least 2%, calculated on the weight of the carboxymethyl cellulose. Exemplary are salts of acetic acid, benzoic acid, lactic acid, propionic acid, tartaric acid, succinic acid, citric acid, nitrous acid, boric acid and carbonic acid, such as sodium carbonate and sodium citrate. One such binder is marketed under the name Peridur ® and is believed to contain the sodium salt of carboxymethyl cellulose, sodium carbonate, and side-products from the formation of the carboxymethyl cellulose salts including sodium chloride and sodium glycolate.

The inventors have studied binder compositions containing alkali metal salts of carboxymethyl cellulose and discovered that the performance of such salts is greatly enhanced by the inclusion of sodium tripolyphosphate. In addition, they have studied binder compositions containing alkali metal salts of carboxymethyl hydroxyethyl cellulose and found that excellent results are obtained when this polymer is used with sodium tripolyphosphate. Accordingly, this invention is a binder composition, useful for agglomerating a metal-containing ore material in the presence of water, comprising, by total dry weight of the binder composition, (a) about 10% to about 90% of an alkali metal salt of carboxymethyl cellulose or carboxymethyl hydroxyethyl cellulose and (b) about 5% to about 90% of sodium tripolyphosphate. In another aspect, the invention is directed to a process for agglomerating a concentrated ore material, which process comprises (a) preparing a mixture comprising a binding amount of (i) an alkali metal salt of carboxymethyl cellulose or carboxymethyl hydroxyethyl cellulose, (ii) sodium tripolyphosphate, (iii) water and (iv) concentrated ore, (b) agglomerating the mixture into wet balls, and (c) drying the wet balls and heating the resultant dry balls at a temperature of at least about 2200° F.; and the agglomerated product of this process.

Water-soluble alkali metal salts of carboxymethyl cellulose or carboxymethyl hydroxyethyl cellulose may be used by themselves or in combination.

Any substantially water-soluble alkali metal salt of carboxymethyl cellulose may be used in this invention. Preferred is the sodium salt. Alkali metal salts of carboxymethyl cellulose, more particularly sodium carboxymethyl cellulose, are generally prepared from alkali cellulose and the respective alkali metal salt of monochloroacetic acid. Cellulose which is used in the manufacture of carboxymethyl cellulose is generally derived from wood pulp or cotton linters, but may be derived from other sources such as sugar beet pulp, bagasse, rice hulls, bran, microbially-derived cellulose, and waste cellulose (e.g., shredded paper). The sodium carboxymethyl cellulose used in this invention generally has a carboxymethyl degree of substitution (C.M.D.S.) (the average number of carboxymethyl ether groups per repeating anhydroglucose chain unit of the cellulose molecule) of from about 0.4 to about 1.5, more preferably about 0.6 to about 0.9, and most preferably about 0.7. Generally the average degree of polymerization is from about 300 to about 4000. Polymers having a degree of polymerization on the higher end of the range are preferred. However, best results are obtained with sodium carboxymethyl cellulose having a Brookfield viscosity in a 1% aqueous solution of less than about 4,000 cps at 20 rpm.

Any substantially water-soluble alkali metal salt of carboxymethyl hydroxyethyl cellulose may be used in this invention. Alkali metal salts of carboxymethyl hydroxyethyl cellulose, more particularly sodium carboxymethyl hydroxyethyl cellulose, are generally prepared from alkali cellulose, ethylene oxide and the respective alkali metal salt of monochloroacetic acid. The cellulose source may be any of those mentioned above as useful for preparing carboxymethyl cellulose. The carboxymethyl hydroxyethyl cellulose used in this invention generally has a C.M.D.S. of about 0.1 to about 1.5, more preferably about 0.25 to about 0.75, and most preferably about 0.4. In addition, it generally has a hydroxyethyl molar substitution (H.E.M.S.) (the average number of hydroxyethyl groups per repeating anhydroglucose chain unit of the cellulose molecule) of from about 0.1 to about 4.0, more preferably from about 1.0 to about 3.0, and most preferably about 2.0. The average degree of polymerization is generally from about 300 to about 3500, more preferably from about 500 to about 2500, and most preferably about 1500.

Sodium tripolyphosphate is a powder or granular salt having the formula $Na_5P_3O_{10}$ prepared by evaporating a saturated orthophosphate solution and calcining at 500° C. It is commercially available from FMC Corporation of Philadelphia, Pa. under its generic name. Commercially available products generally contain minor amounts of impurities, e.g., disodium pyrophosphate and tetrasodium pyrophosphate.

The amounts of water-soluble polymer and sodium tripolyphosphate to be used in the binder composition of this invention are dependent on the specific agglomeration method used, the nature of the concentrated ore to be agglomerated and the desired properties of the agglomerates to be prepared. A person of ordinary skill in the art can readily determine the specific amounts that will be most suitable for individual circumstances. Pelletization is generally carried out using water-soluble polymer in an amount of about 10% to about 90%, more preferably about 30% to about 70%, and sodium tripolyphosphate in amount of about 5% to about 90%, more preferably about 30% to about 70%, both by total dry weight of the binder composition.

The binder composition may also contain other substances, for instance, those that are formed as by-products in the preparation of the alkali metal salt of carboxymethyl cellulose, such as sodium chloride and sodium glycolate, as well as other polysaccharides or synthetic water-soluble polymers and other "inorganic salts" (for want of a better term sodium carbonate, sodium citrate, and the like are referred to as "inorganic salts" herein). Exemplary polysaccharides include, e.g., hydroxyethyl cellulose, hydroxypropyl cellulose, hydrophobically modified hydroxyethyl cellulose, methyl cellulose, hydroxypropyl methyl cellulose, guar, hydroxypropyl guar and sugar beet pulp, etc. Exemplary synthetic water-soluble polymers include polyacrylamide, polyvinyl alcohol, styrene/maleic anhydride copolymers, and polyacrylate, etc. Exemplary inorganic salts include, e.g, the salts described by Roorda in U.S. Pat. Nos. 4,288,245 and 4,597,797, such as sodium carbonate, sodium citrate, etc., and other phosphate salts, such as monosodium phosphate (sodium phosphate mono basic), disodium phosphate (sodium phosphate di basic), sodium tripolyphosphate, tetrapotassium pyrophosphate, tetrasodium pyrophosphate, and sodium metaphosphate [$(NaPO_3)_n$ wherein n is 2 or more (sodium metaphosphate wherein n is 6, 13 and 21 are commercially available from FMC Corporation)].

Any known method for forming dry pellets or particles can be used to prepare the agglomerates of this invention. For instance, the concentrated ore may be agglomerated into particles or pellets by rotating the concentrated ore powder in a drum or disc with a binder and water, followed by drying and firing. Pellets can also be formed by briquetting, nodulizing, or spray drying.

Addition of the binder composition constituents may be carried out in a manner commonly applied in the art. For instance, the binder constituents may be mixed as solid matter with the concentrated ore or while dissolved in water. Further, they may be simultaneously, successively or alternatively added to the concentrated ore before or during the pelletizing treatment. In a preferred method the binder composition is added to a moist concentrated ore resulting from the aforementioned separation process, which has all but about 10 wt. % of the water removed by, e.g., rotating disc filter, at a sufficient point upstream from the agglomerating drum or disc so that the binder components and concentrated ore are well mixed and adequately hydrated prior to being formed into balls.

The ratios of alkali metal salt of carboxymethyl cellulose, sodium tripolyphosphate and water to concentrated ore used in the process of this invention are dependent on the specific agglomeration method used, the nature of the ore material to be agglomerated and the desired properties of the agglomerates to be prepared. A person of ordinary skill in the art can readily determine the specific amounts that will be most suitable for individual circumstances.

Commercial pelletizing operations desire to use as little binder as possible due to the adverse effects of the inorganic components of the binder on the steel made using the pellets and on the blast furnace. The organic portions of the binder are consumed during pelletization and have no effect on the resultant steel, whereas the inorganic components remain in the pellets.

Sodium is an undesirable alkali contaminant in blast furnace operations. High levels of alkali cause increased refractory wear leading to premature failure of furnace lining material.

During steelmaking phosphates are reduced to elemental phosphorus. This phosphorus is found in the resultant steel. It is known to have adverse effects on the physical properties of the steel such as reduced castability, i.e., increased brittleness and reduced strength.

Operators also prefer to use lower amounts of binder composition, as this reduces the amount of material that must be handled before and during pelletization. In addition, use of lower amounts of binder composition is more economical.

Thus, while pelletization is carried out using the binder composition in an amount of from about 0.0044% to about 0.44% of the binder composition, by weight of the total dry mixture, lower amounts are preferably used. Typically, operators will use the lowest amount of binder that will consistently provide the minimal strength properties necessary for handling and transportation of pellets. Typically, pelletization is carried out with about 0.022% (0.5 lb/long ton) to about 0.067% (1.5 lb/long ton), preferably about 0.033% (0.75 lb/long ton) to about 0.56% (1.25 lb binder/long ton ore) of the binder composition.

For suitable binding, water is present in an amount of about 5% to about 20%, preferably about 7% to about 15%, and most preferably about 8.5% to about 10%, by weight of the moist concentrated ore.

Clays, such as bentonite clay, may be used along with the binders of this invention. The total amount of these clays will depend on the user's objectives, but will generally be less than 0.22%, based on the weight of the total dry mixture.

Small amounts of flux, e.g., limestone or dolomite, may also be added to enhance dry strength. The flux also helps to reduce the dust level in the indurating furnace when the balls are fired. Olivine, serpentine and similar minerals may be used to improve fired pellet properties.

Drying the wet balls and firing the resultant dry balls may be carried out as one continuous or two separate steps. The important factor is that the balls must be dry prior to firing as the balls will degrade or spall if fired without first drying them. Thus, in one embodiment of this invention, the wet balls are heated slowly to a temperature of at least about 2200° F., preferably to at least about 2400° F., and then fired at that temperature. In another embodiment, they are dried at low temperatures, preferably by heating, or, alternatively, under ambient conditions, and then fired at a temperature of at least about 2200° F., more preferably at about 2400° F. Firing is carried out for a sufficient period of time to bond the small particles into pellets, generally about 15 minutes to about 3 hours.

The process of this invention is generally employed with concentrated iron ore. This process is also suitable for non-ferrous concentrated ores such as ores of zinc, lead, tin, nickel and chromium and oxidic materials such as silicates and quartz, and sulphidic materials. As a practical matter, this invention is intended for use in binding the concentrated ores which result from separation of the host rock from the ore removed from the ground. However, it can also be used to bind natural ores.

The pellets resulting from this process are dry, hard agglomerates having sizes that are suitable for, e.g., shipping, handling, sintering, etc. Pellets generally have an average diameter of about ¼ to about ¾ inch, preferably about ⅜ inch. Pellet size is generally a function of the user and operator's preference, more than of binding ability of the compositions of this invention and virtually any size pellet desired by blast furnace operators and mine operators can be prepared.

This invention is illustrated in the following examples, wherein all parts, percentages, etc., are by weight unless otherwise indicated.

EXAMPLE 1

This example is directed to preparation and testing of wet and dry balls prepared using the binder of this invention.

The ore used was a magnetic taconite concentrate containing approximately 65 wt. % iron and approximately 4.6 wt. silica obtained from a U.S. operation. In a Hobart model N-50 oscillating mixer, 3240 g of the ore concentrate, having a moisture content of 7.4%, was mixed with additional water (distilled) to obtain the desired moisture level. The chosen quantity of dry binder blend was then sprinkled onto the surface of the moist concentrated ore and mixing was continued for 3 minutes. Next, the concentrate ore/binder mix was passed one time through a high speed shredder to make a uniform, clump free blend suitable for balling.

Balls were made in a 15 inch diameter (size 6.00–6) airplane tire, rotated at a rate of 65 revolutions per minute with the axis of rotation being horizontal, as follows:

1. Small amounts of concentrated ore were fed by hand into the rotating tire alternately with distilled water mist. As seed balls formed they were removed and hand screened to −4.75, +4 mm. A portion (800 g) of concentrate was set aside for seed preparation. This process was continued until at least 100 g of seed balls were generated.

2. Ninety-two (92) g of prepared seed balls were put in the rotating tire and moistened slightly with a fine mist spray of distilled water. Part of the remaining 2440 g of concentrate was added to the seeds as quickly as possible over a 1 minute period. The balls were removed and the newly formed seeds (−4.75 mm) were screened out and discarded.

3. The +4.75 mm balls were returned to the rotating tire and the remainder of the concentrate was added over a 1–1½ minute time period. The finished balls were then rolled for 5 seconds.

4. The wet balls were screened to determine size distribution. A −12.7, +11.2 mm cut was used to determine moisture content.

Two standard tests were used to measure performance, i.e., the drop test and the compressive strength test. The drop test and compressive strength test demonstrate the ability of wet and dry balls to withstand cracking under normal handling conditions. Balls must have sufficient prefired strength so that they do not crack during handling or transfer in the pellet plant, but must not be so plastic that they deform and impair bed permeability in the indurating furnace.

The drop test was carried out by dropping the wet balls repeatedly from a height of 18 inches onto a smooth steel plate. The number of drops required to crack a ball was recorded and the average value for 10 balls reported.

Compressive strength was measured by applying pressure to both wet and dry pellets until the pellets crumbled. The apparatus consisted of a Chatillon Model No. LTCM-3 spring testing device (manufactured by John Chatillon Company, New York, N.Y.) with appropriate range dial push-pull gauge (5 lb. capacity for wet, 25 lb. for dry). Dried balls were obtained by placing green balls in a 105° C. oven for 18 hours. Average wet ball moisture was determined comparing the weight of balls before and after drying. Compressive strength results presented are also the average of 10 balls tested.

Generally mine operators require that green balls be able to withstand at least 6 drops. Similarly, dry compressive strength of 10 or more pounds is desired. In practice, however, it has been difficult to attain dry strengths of greater than 5 lbs. with non-bentonite binders at economically acceptable use levels.

The formulations used and results obtained are shown in the following Table 1.

TABLE 1

| Sample | Polysaccharide(s)[1] (%) | STPP[2] (%) | Drop Number | Wet Compr. Strength (lbs) | Dry Compr. Strength (lbs) | Ball Moisture (%) |
|---|---|---|---|---|---|---|
| 1-1 | 0.033 CMC 7HX[3] | 0.033 | 4.1 | .78 | 4.8 | 8.0 |
| 1-2 | 0.033 CMC 7HX | 0.033 | 11.2 | 1.3 | 6.0 | 8.9 |
| 1-3 | 0.033 CMC 7HX | 0.033 | 14.9 | 1.4 | 6.3 | 9.8 |
| 1-4 | 0.033 CMC 7LX[4] | 0.033 | 6.0 | 1.4 | 4.9 | 9.3 |
| 1-5 | 0.033 CMC 7MX[5] | 0.033 | 9.1 | 1.5 | 6.5 | 9.2 |
| 1-6 | 0.033 CMC 7HX | 0.033 | 15.8 | 1.5 | 7.2 | 9.5 |
| 1-7 | 0.064 CMC 7HX | 0.003 | 13.8 | 1.3 | 5.1 | 9.2 |
| 1-8 | 0.030 CMC 7HX | 0.037 | 16.3 | 1.5 | 6.4 | 9.2 |
| 1-9 | 0.010 CMC 7HX | 0.057 | 5.6 | 1.3 | 5.3 | 9.2 |
| 1-10 | 0.011 CMC 7HX | 0.011 | 3.1 | 1.0 | 1.5 | 8.8 |
| 1-11 | 0.033 CMC 7HX | 0.033 | 11.2 | 1.4 | 4.6 | 9.0 |
| 1-12 | 0.067 CMC 7HX | 0.067 | 17.3 | 1.5 | 7.9 | 9.8 |
| 1-13 | 0.022 CMC 7HX | 0.022 | 10.1 | 1.4 | 4.8 | 9.5 |
| | 0.022 SBP[6] | — | — | | | |

[1]Percentage is based on the total weight of the dry composition, including concentrated ore.
[2]Sodium tripolyphosphate. Percentage is based on the total weight of the dry composition, including concentrated ore.
[3]Sodium carboxymethyl cellulose having a degree of polymerization of 3200, available from Aqualon Company, Wilmington, DE.
[4]Sodium carboxymethyl cellulose having a degree of polymerization of 400, available from Aqualon Company, Wilmington, DE.
[5]Sodium carboxymethyl cellulose having a degree of polymerization of 1100 available from Aqualon Company, Wilmington, DE.
[6]Cellulose derivative produced from sugar beet pulp available from Petroleum Fluids Incorporated, Houston, Texas, under the name HP-007 having an apparent viscosity at 7 lbs./barrel in a 4% CaCl solution of 18.5 cps.

EXAMPLE 2

This example compares binders of this invention with binders containing other phosphate salts. This example was carried out in the same manner as described in Example 1, except for the differences mentioned below.

The ore was from a different U.S. operation than that used in Example 1. It was a magnetic taconite concentrate containing approximately 65 wt.% iron and approximately 4.5 wt. % silica.

The ore placed in the Hobart mixer had a moisture content of 7.2%. Only 3234 g was used (Note: as a result only 2434 g of ore remained for addition to the seeds in step 2).

The binder formulations and amounts used, and the results obtained are shown in the following Table.

TABLE 2

| Sample | Polysaccharide(s)[1] (%) | Salt | Dosage (lbs/t)[2] | Wet Drop Number | Wet Compr. Strength (lbs) | Dry Compr. Strength (lbs) | Ball Moisture (%) |
|---|---|---|---|---|---|---|---|
| 2-1 | CMC 7HX[3] | Sodium Tripolyphosphate[4] | 1.0 | 10.4 | 1.4 | 4.2 | 9.3 |
| 2-2 | CMC 7HX[3] | Tetrasodium Pyrophosphate[4] | 1.0 | 10.1 | 1.5 | 4.6 | 9.4 |
| 2-3 | CMC 7HX[3] | Diammonium Phosphate[2] | 1.0 | 3.5 | 1.4 | 2.8 | 9.1 |
| 2-4 | CMC 7HX[3] | Disodium Phosphate[4] | 1.0 | 6.4 | 1.0 | 3.9 | 9.2 |
| 2-5 | CMC 7HX[3] | Sodium Tetrametaphosphate[4,6] | 1.0 | 7.2 | 1.3 | 4.1 | 9.5 |
| 2-6 | CMC 7HX[3] | Sodium Hexametaphosphate[4,7] | 1.0 | 7.9 | 1.2 | 3.6 | 9.2 |
| 2-7 | CMC 7HX[3] | Potassium Phosphate MonoBasic[4] | 1.0 | 2.0 | 1.0 | 2.0 | 9.0 |

[1]Percentage is based on the total weight of the dry composition, including concentrated ore.
[2]Kg of binder composition per tonne of ore. All runs were conducted using a 1:1 ratio of polysaccharide to salt.
[3]Aqualon TM CMC 7HX is sodium carboxymethyl cellulose, available from Aqualon Company, Wilmington, DE.
[4]Available from FMC Corporation, Philadelphia, Pennsylvania.
[5]Available from Stauffer Chemical Co., Westport, Connecticut
[6]$[NaPO_3]n$, wherein n = 6.
[7]$[NaPO_3]n$, wherein n = 21.

EXAMPLE 3

This example was carried out in the same manner as Example 1. The control samples were carried out using Aqualon TM CMC 7HX (Aqualon Company, Wilmington, Del.). In the other samples a 1:1 ratio of Aqualon TM CMC 7HX to salt was used. Results are shown in Table 3.

TABLE 3

| Sample | Salt | Dosage (lbs/t)[1] | Wet Drop Number | Wet Compr. Strength (lbs) | Dry Compr. Strength (lbs) | Ball Moisture (%) |
|---|---|---|---|---|---|---|
| 3-1 | — | 0.75 | 6.6 | 1.1 | .9 | 8.9 |
| 3-2 | — | 1.5 | 17.6 | 1.1 | 2.9 | 9.5 |
| 3-3 | Sodium Tripolyphosphate[2] | 1.5 | 10.1 | 1.6 | 3.3 | 9.2 |
| 3-4 | Sodium Tripolyphosphate[2] | 1.5 | 10.6 | 1.5 | 3.0 | 9.3 |
| 3-5 | Sodium Carbonate | 1.5 | 6.9 | 1.4 | 3.1 | 9.3 |

TABLE 3-continued

| Sample | Salt | Dosage (lbs/t)[1] | Wet Drop Number | Wet Compr. Strength (lbs) | Dry Compr. Strength (lbs) | Ball Moisture (%) |
|---|---|---|---|---|---|---|
| 3-6 | Calcium Carbonate | 1.5 | 5.4 | 1.2 | 0.78 | 9.1 |
| 3-7 | $Na_2SO_4$ | 1.5 | 5.6 | 1.3 | 0.86 | 9.1 |
| 3-8 | Sodium Formate | 1.5 | 3.5 | 1.0 | 0.59 | 9.1 |
| 3-9 | Sodium Benzoate | 1.5 | 3.6 | 1.2 | 0.82 | 9.1 |
| 3-10 | $NaNO_3$ | 1.5 | 3.7 | 1.0 | 0.73 | 9.1 |
| 3-11 | Sodium Nitrilotriacetate | 1.5 | 12.9 | 1.6 | 2.4 | 9.3 |
| 3-12 | Sodium Tetraborate | 1.5 | 6.6 | 1.4 | 1.4 | 9.5 |
| 3-13 | Sodium Citrate | 1.5 | 15.0 | 1.5 | 4.6 | 9.7 |
| 3-14 | Calcium Chloride | 1.5 | 3.4 | 0.90 | 0.36 | 8.8 |
| 3-15 | Sodium Chloride | 1.5 | 3.1 | 1.0 | 0.59 | 9.1 |
| 3-16 | Sodium Hexametaphosphate | 1.5 | 13.2 | 1.5 | 3.7 | 9.2 |

[1]Kg of binder composition per tonne of ore.
[2]Available from FMC Corporation, Philadelphia, Pennsylvania.

EXAMPLE 4

This example is directed to preparation and testing of wet and dry balls prepared using the binder of this invention.

The ore used was a magnetic taconite concentrate containing approximately 65 wt. % iron and approximately 4.8 wt. silica obtained from a U.S. operation. In a Hobart model N-50 oscillating mixer, 3261 g of the ore concentrate, having a moisture content of 8.0%, was mixed with 54 g additional water (distilled) to obtain the desired 9.5% moisture level. The chosen quantity of dry binder blend was then sprinkled onto the surface of the moist concentrated ore and mixing was continued for 3 minutes. Next, the concentrate ore/binder mix was passed one time through a high speed shredder to make a uniform, clump free blend suitable for balling. Testing was carried out in the same manner as in Example 1. (Note that since 3261 g of ore was used, 2461 g were available for the step labeled 2 in Example 1.)

TABLE 4

| Sample | Polysaccharide (%) | Salt | Dosage (lbs/t)[1] | Wet Drop Number | Dry Compr. Strength (lbs) | Ball Moisture (%) |
|---|---|---|---|---|---|---|
| 4-1 | Aqualon TM CMHEC 420H[2] | — | 0.5 | 4.7 | 1.9 | 9.2 |
| 4-2 | Aqualon TM CMHEC 420H | — | 1.0 | 9.5 | 3.2 | 9.3 |
| 4-3 | Aqualon TM CMHEC 420H | Sodium Tripolyphosphate | 1.0 | 6.1 | 3.2 | 9.1 |
| 4-4 | Aqualon TM CMHEC 420H | Sodium Tripolyphosphate | 2.0 | 14.1 | 7.1 | 9.2 |
| 4-5 | Aqualon TM CMHEC 420H | Sodium Hexametaphosphate | 1.0 | 5.8 | 2.1 | 9.1 |
| 4-6 | Aqualon TM CMHEC 420H | Sodium Hexametaphosphate | 2.0 | 12.7 | 7.4 | 9.3 |
| 4-7 | Aqualon TM CMHEC 420H | Disodium Phosphate | 1.0 | 3.9 | 2.2 | 9.1 |
| 4-8 | Aqualon TM CMHEC 420H | Disodium Phosphate | 2.0 | 9.9 | 5.3 | 9.2 |
| 4-9 | Aqualon TM CMHEC 420H | Tetrasodium Pyrophosphate | 1.0 | 4.4 | 2.7 | 9.2 |
| 4-10 | Aqualon TM CMHEC 420H | Tetrasodium Pyrophosphate | 2.0 | 14.5 | 7.4 | 9.3 |
| 4-11 | Aqualon TM CMHEC 420H | Sodium Carbonate | 1.0 | 5.3 | 2.9 | 9.1 |
| 4-12 | Aqualon TM CMHEC 420H | Sodium Carbonate | 2.0 | 11.7 | 7.7 | 9.2 |
| 4-13 | Peridur XC-3[3] | | 1.0 | 4.2 | 2.4 | 9.1 |
| 4-14 | Peridur XC-3[3] | | 2.0 | 8.6 | 6.0 | 9.3 |
| 4-15 | Aqualon TM CMHEC 7HX[4] | Sodium Tripolyphosphate | 1.0 | 8.5 | 5.8 | 9.3 |

[1]Lb. of binder composition per long ton of ore.
[2]Carboxymethyl Hydroxyethyl Cellulose. Available from Aqualon Company, Wilmington, DE.
[3]A blend believed to comprise carboxymethyl cellulose and sodium carbonate, available from Akzo NV, Arnhem, The Netherlands.
[4]Sodium Carboxymethylcellulose. Available from Aqualon Company, Wilmington, DE.

EXAMPLE 5

The procedures of Example 3 were repeated using carboxymethyl hydroxyethyl cellulose (Aqualon TM CMHEC 420H, available from Aqualon Company, Wilmington, De.). In each blend, a 1:1 ratio of CMHEC/salt was used. Results are shown in Table 5.

TABLE 5

| Sample | Salt | Dosage (lbs/t)[1] | Wet Drop Number | Wet Compr. Strength (lbs) | Dry Compr. Strength (lbs) | Ball Moisture (%) |
|---|---|---|---|---|---|---|
| 5-1 | — | 0.75 | 6.1 | 1.2 | 0.82 | 9.0 |
| 5-2 | Sodium Tripolyphosphate | 1.5 | 11.1 | 1.3 | 1.8 | 9.2 |
| 5-3 | Sodium Carbonate | 1.5 | 7.1 | 1.2 | 1.4 | 9.1 |
| 5-4 | Calcium Carbonate | 1.5 | 8.1 | 1.3 | 0.68 | 9.3 |
| 5-5 | $Na_2SO_4$ | 1.5 | 6.9 | 1.4 | 0.68 | 9.2 |
| 5-6 | Sodium Formate | 1.5 | 5.3 | 1.3 | 0.82 | 9.2 |
| 5-7 | Sodium Citrate | 1.5 | 8.3 | 1.5 | 2.3 | 9.2 |

[1]Lb. of binder composition per long ton of ore.

EXAMPLE 6

This example was carried out in the same manner as Example 1, using the polysaccharides and salts described in the following table. In each blend, the ratio of polysaccharide to salt was 1:1.

The ore used was from a third U.S. operation, and had an iron and silica concentration similar to that of the ore of Example 1.

The ore placed in the Hobart mixer had a moisture content of 8.1%.

In this example, 3264 g of ore concentrate and 51 g of distilled water was used to bring the initial moisture level to 9.5% (Note: as a result, 2464 g of ore concentrate was available for addition to the seeds in step 2).

TABLE 6

| Sample | Polysaccharide (%) | Salt | Dosage (lbs/t)[1] | Wet Drop Number | Wet Compr. Strength (lbs) | Dry Compr. Strength (lbs) | Ball Moisture (%) |
|---|---|---|---|---|---|---|---|
| 6-1 | Aqualon TM CMC 7HX[2] | — | 1.0 | 9.1 | 1.1 | 2.7 | 9.2 |
| 6-2 | Aqualon TM CMC 7HX | Sodium Tripolyphosphate | 1.0 | 6.7 | 1.3 | 2.5 | 9.1 |
| 6-3 | Aqualon TM CMC 7HX | Sodium Tripolyphosphate | 2.0 | 10.7 | 1.1 | 4.7 | 9.2 |
| 6-4 | Aqualon TM CMC 7HX | Sodium Tripolyphosphate | 2.0 | 11.5 | 1.1 | 4.1 | 9.2 |
| 6-5 | Aqualon TM CMC 7HX | Sodium Hexametaphosphate | 1.0 | 5.8 | 1.3 | 2.0 | 9.1 |
| 6-6 | Aqualon TM CMC 7HX | Sodium Hexametaphosphate | 2.0 | 11.0 | 1.1 | 4.8 | 9.2 |
| 6-7 | Aqualon TM CMC 7HX | Sodium Hexametaphosphate | 2.0 | 14.2 | 1.1 | 5.2 | 9.4 |
| 6-8 | Aqualon TM CMHEC 420H[3] | — | 1.0 | 6.6 | 2.0 | 2.5 | 9.1 |
| 6-9 | Aqualon TM CMHEC 420H | Sodium Tripolyphosphate | 2.0 | 8.6 | 2.8 | 4.7 | 9.1 |
| 6-10 | Aqualon TM CMHEC 420H | Sodium Hexametaphosphate | 2.0 | 9.3 | 2.4 | 5.2 | 9.2 |
| 6-11 | Aqualon TM CMHEC 420H | Tetrasodium Pyrophosphate | 2.0 | 10.1 | 2.5 | 6.1 | 9.1 |
| 6-12 | Aqualon TM CMHEC 420H | Disodium Phosphate | 2.0 | 10.9 | 3.1 | 4.8 | 9.2 |
| 6-13 | Peridur XC-3[4] | | 2.0 | 6.0 | 2.0 | 7.1 | 9.1 |

[1]Lb. of binder composition per long ton of ore.
[2]Sodium Carboxymethyl cellulose. Available from Aqualon Company, Wilmington, DE.
[3]Carboxymethyl Hydroxyethyl Cellulose. Available from Aqualon Company, Wilmington, DE.
[4]A blend believed to comprise carboxymethyl cellulose and sodium carbonate, available from Akzo NV, Arnhem, The Netherlands.

The data in Tables 1–6 show that the binder of this invention performs very well as compared to other binders. Most notable is the strong performance of the binder of this invention at low levels (see, e.g., Examples 4-3 and 6-2).

While this invention has been described with respect to specific embodiments, it should be understood that these embodiments are not intended to be limiting and that many variations and modifications are possible without departing from the scope of this invention.

We claim:

1. A process for agglomerating a concentrated ore, which process comprises:

(a) preparing a mixture comprising a binding amount of a binder composition containing a binding amount of (i) water-soluble polymer selected from the group consisting of alkali metal salts of carboxymethyl cellulose and carboxymethyl hydroxyethyl cellulose and (ii) sodium tripolyphosphate, the concentrated ore and water, said water-soluble polymer and said sodium tripolyphosphate being added simultaneously, successively, or alternatively;

(b) agglomerating the mixture into wet balls; and (c) drying the wet balls and then firing the resultant dry balls at a temperature of at least about 2200° F., wherein the mixture contains from about 0.022% to about 0.067% of the binder composition, by weight of the dry mixture, and from 5% to about 20% water, based on total weight of the moist mixture, and the binder composition contains from about 10% to about 90% of the water-soluble polymer and from about 5% to about 90% of the sodium tripolyphosphate, by weight of the total dry binder composition.

2. The process of claim 1 wherein the mixture contains from about 7% to about 15% water.

3. The process of claim 1 wherein the mixture contains from about 8.5% to about 10% water.

4. The process of claim 1 wherein the concentrated ore is concentrated iron ore.

5. The process of claim 1 wherein the mixture contains from about 0.033% to about 0.056% of the binder composition.

6. The process of claim 1 wherein the binder composition contains about 30% to about 70% of the water-soluble polymer and from about 30% to about 70% of the sodium tripolyphosphate.

7. The process of claim 1 wherein the water-soluble polymer is sodium carboxymethyl cellulose having a carboxymethyl degree of substitution of about 0.4 to about 1.5.

8. The process of claim 1 wherein the water-soluble polymer is sodium carboxymethyl cellulose having a carboxymethyl degree of substitution of about 0.6 to about 0.9.

9. The process of claim 8 wherein the sodium carboxymethyl cellulose has an average degree of polymerization of 300 to 3500.

10. The process of claim 1 wherein the water-soluble polymer is sodium carboxymethyl hydroxyethyl cellulose having a carboxymethyl degree of substitution of about 0.1 to about 1.5 and a hydroxyethyl molar substitution of from about 0.1 to about 4.

11. The process of claim 1 wherein the sodium carboxymethyl hydroxyethyl cellulose has an average degree of polymerization of about 300 to about 3500.

12. The process of claim 6 wherein the water-soluble polymer is sodium carboxymethyl cellulose having a carboxymethyl degree of substitution of from about 0.6 to about 0.9 and is formed from a cellulose furnish having an average degree of polymerization of from about 300 to about 4000, and the concentrated ore is concentrated iron ore.

13. The process of claim 6 wherein the water-soluble polymer is sodium carboxymethyl hydroxyethyl cellulose having a carboxymethyl degree of substitution of from about 0.25 to about 0.75, a hydroxyethyl molar substitution of about 1.0 to about 3.0 and a degree of polymerization of about 500 to about 2500, and the concentrated ore is concentrated iron ore.

14. The process of claim 1 wherein the firing is carried out at a temperature of at least about 2200° F.

15. The process of claim 1 wherein the firing is carried out for from about 15 minutes to about 3 hours.

16. The process of claim 11 wherein the firing is carried out at a temperature of at least about 2200° F. for from about 15 minutes to about 3 hours.

17. The process of claim 12 wherein the firing is carried out for from about 15 minutes to about 3 hours.

18. The agglomerated product prepared by the process of claim 1.

19. A binder composition useful for agglomerating a concentrated ore in the presence of water comprising, by total dry weight of the binder composition, (a) about 10% to about 90% of a water-soluble polymer selected from the group consisting of alkali metal salts of carboxymethyl hydroxyethyl cellulose and (b) about 5% to about 90% sodium tripolyphosphate.

20. The binder composition claimed in claim 19 wherein the water-soluble polymer is sodium carboxymethyl hydroxyethyl cellulose having a carboxymethyl degree of substitution of about 0.25 to about 0.75, a hydroxyethyl molar substitution of about 1.0 to about 3.0, and an average degree of polymerization of 500 to 2500.

* * * * *

UNITED STATES PATENT AND TRADEMARK OFFICE

CERTIFICATE OF CORRECTION

PATENT NO. : 4,919,711

DATED : APRIL 24, 1990

INVENTOR(S) : BANYAI, LASOTA & STRUNK

It is certified that error appears in the above-identified patent and that said Letters Patent is hereby corrected as shown below:

TITLE PAGE [75] Inventors:

"Struck" should read --Strunk--

TITLE PAGE [57] ABSTRACT, Line 4

"celluylose" should read --cellulose--

Column 6, Line 11

"wt. silica" should read --wt. % silica--

Column 9, Line 36

"CMHEC $7HX^4$" should read --CMC $7HX^4$--

UNITED STATES PATENT AND TRADEMARK OFFICE

CERTIFICATE OF CORRECTION

PATENT NO. : 4,919,711

DATED : April 24, 1990

INVENTOR(S) : Banyai, Lasota & Strunk

It is certified that error appears in the above-identified patent and that said Letters Patent is hereby corrected as shown below:

Column 9, Line 45

"wt. silica" should read --wt. % silica--.

Signed and Sealed this

Seventh Day of May, 1991

*Attest:*

HARRY F. MANBECK, JR.

*Attesting Officer*

*Commissioner of Patents and Trademarks*